US007334508B2

(12) United States Patent
Heaven

(10) Patent No.: US 7,334,508 B2
(45) Date of Patent: Feb. 26, 2008

(54) ROTATING SCREW DRIVER HEAD

(76) Inventor: Jonathan Mark Heaven, P.O. Box 156. STN Main, Delta, B.C. (CA) V4K 3N4

( * ) Notice: Subject to any disclaimer, the term of this patent is extended or adjusted under 35 U.S.C. 154(b) by 0 days.

(21) Appl. No.: 11/389,374

(22) Filed: Mar. 27, 2006

(65) Prior Publication Data

US 2007/0221017 A1 Sep. 27, 2007

(51) Int. Cl.
*B25G 1/08* (2006.01)
*B25B 23/16* (2006.01)

(52) U.S. Cl. ..... 81/440; 81/490

(58) Field of Classification Search ..... 81/439, 81/440, 490

See application file for complete search history.

(56) References Cited

U.S. PATENT DOCUMENTS 3,194,286 A * 7/1965 Wagner ..... 81/439
3,892,149 A * 7/1975 Rydberg ..... 81/440
4,010,663 A * 3/1977 Rydberg ..... 81/440
4,327,790 A * 5/1982 Stevens et al. ..... 81/177.4
4,440,048 A * 4/1984 Stevens et al. ..... 81/440
4,476,751 A * 10/1984 Mishima ..... 81/440
4,815,346 A * 3/1989 Littlehorn ..... 81/439
5,803,584 A * 9/1998 Chung ..... 362/120
6,032,332 A * 3/2000 Lin ..... 16/111.1
6,332,384 B1 * 12/2001 Cluthe ..... 81/490
6,511,199 B1 * 1/2003 Chung ..... 362/119
6,845,694 B2 * 1/2005 Ping ..... 81/440
2004/0112185 A1 * 6/2004 Ping ..... 81/440

* cited by examiner

*Primary Examiner*—David B Thomas

(57) ABSTRACT

A tool for loosening or tightening screws. The tool has a number of shafts with screwdriver bits on their ends that are stored in elongated grooves that are parallel to the longitudial axis and circumferentally spaced around the handle. Each stored blade can be rotated separately out of the storage handle 180 degrees on a pivoting hinge into a housing head which locks the extended shafts in place for operation. The housing head can be rotated 360 degrees perpendicular to the elongated axis of the handle in order to accomadate each blade separately.

10 Claims, 4 Drawing Sheets

ROTATING SCREW DRIVER HEAD

BACKGROUND OF THE INVENTION

1. Field of the Invention

The invention relates to hand tools, and in particularly to a multi-purpose hand tool having a plurality of shafts such as screw driver blades or bits.

2. Description of the Prior Art

Presently there are multi hand tools well known in the tool art. There are known various tool sets comprised of a handle and a set of tool bits adapted for attaching to the handle. These tool sets must be carefully received in a tool box or the like when not in use. Because the tool bits of a tool set are separately received, they tend to be lost in the work place.

In order to solve the existing above mention problem in a conventional hand tool set, the innovative structure of the present invention mitigates this problem.

SUMMARY OF THE INVENTION

It is a first object of the present invention to provide the user an innovated structure for hand tools which keeps a set of tool bits retained together to be conveniently selected when needed.

It is a second object of the present invention to provide the user an innovated structure for hand tools which enables tool bits that can be alternatively turned between the operative position and the non-operative position.

It is the third object of the present invention to provide the user an innovated structure for hand tools which prevents the tool bits their loss as is frequently experienced with other conventional hand tools.

DESCRIPTION OF THE DRAWINGS

The drawings disclose an illustrative description of the invention by way of reference with the preferred embodiment.

DESCRIPTION OF THE PREFERRED EMBODIMENTS

Figure 1:
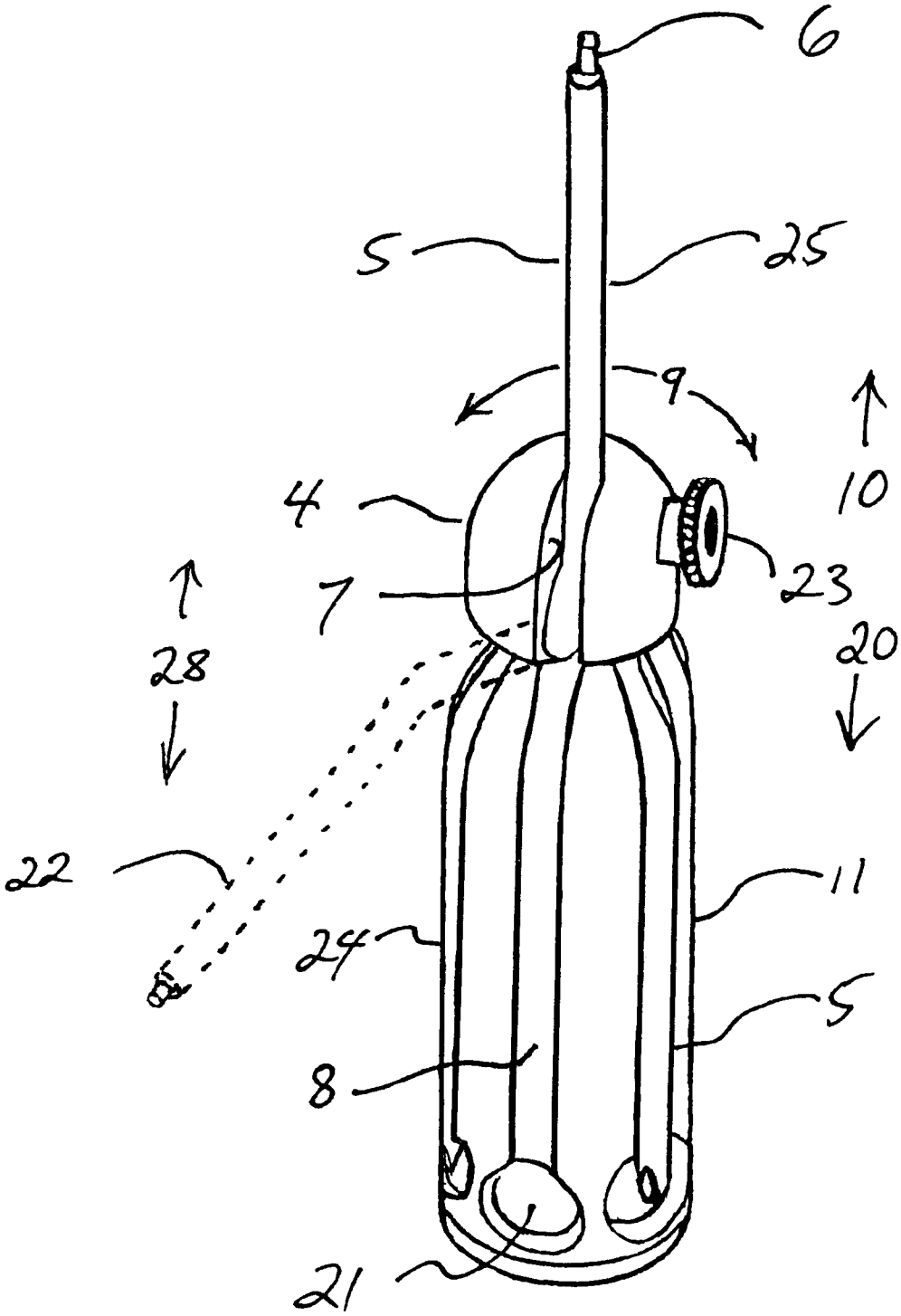
FIG. 1 is a perspective view of the hand tool with a tool bit in an operative position and a shadow view of the same tool bit halfway between the operative position and the stored position, other tool bits are shown in a stored position.

Referring to the drawings and its numbers in order to promote an understanding of the preferred embodiment this invention is a hand tool designed to loosen or tighten screws.

Figure 2:
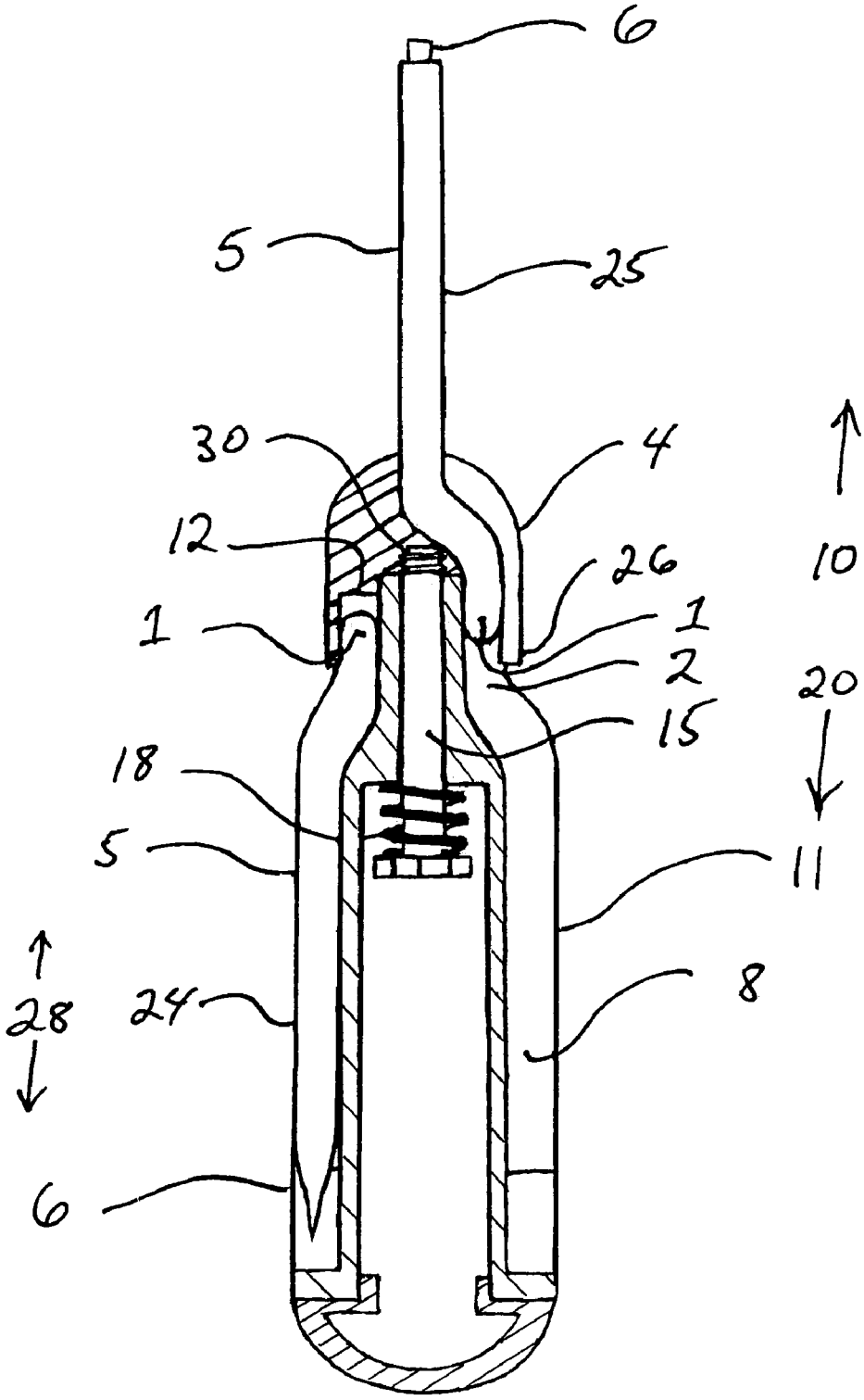
FIG. 2 is a longitudial cross sectional view of the hand tool with a tool bit in an operative position and another tool bit in a stored position.

The hand tools main body is a substantially cylindrical storage handle 11 which has a plurality of longitudinally extending tool storage slots 8 and each tool storage slots 8 accommodates tool blades 5 as shown in FIG. 1 and FIG. 2.

Each tool blades end 6 is specifically designed to interact with different screw heads as shown in FIG. 1 and FIG. 2.

Figure 5:
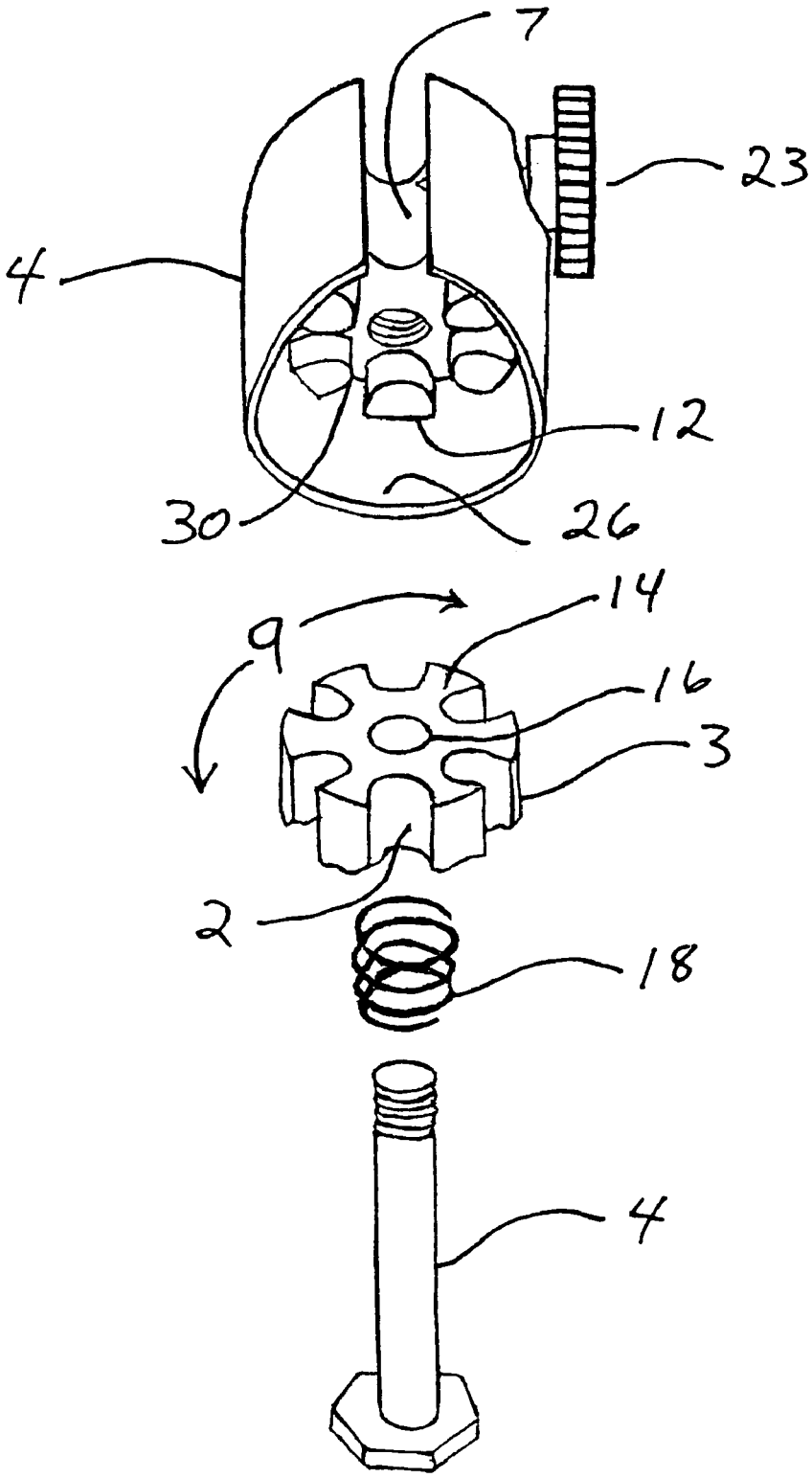
FIG. 5 is an exploded perspective view of the inside of the housing device, a cut out of the top head of the storage handle, the spring and the connecting bolt.

The tool blades 5 are attached to the storage handle 11 at the opposite end of the tool blades end 6 by a pin 1 which runs through and is perpendicular to the tool blades 5 longitudinal axis 28 and is embedded into the storage slot wall 2 at the storage handle head 3 which acts a pivot point for the tool blades 5 as shown in FIG. 2 and FIG. 5.

There is a housing head 4 which is connected by a bolt 15 and thread 30 to the storage handle 11 through a central axis hole 16 at the end of the storage handle end 3 and held snug by a spring 18 as shown in FIG. 2 and FIG. 5.

The housing head 4 has indents 12 which rests in the tool storage slots ends 14 of the storage handle head 3 which prevents the housing head 4 to rotate 9 perpendicular to the longitudinal axis 28 of the storage handle 11 as shown in FIG. 2 and FIG. 5.

Figure 3:
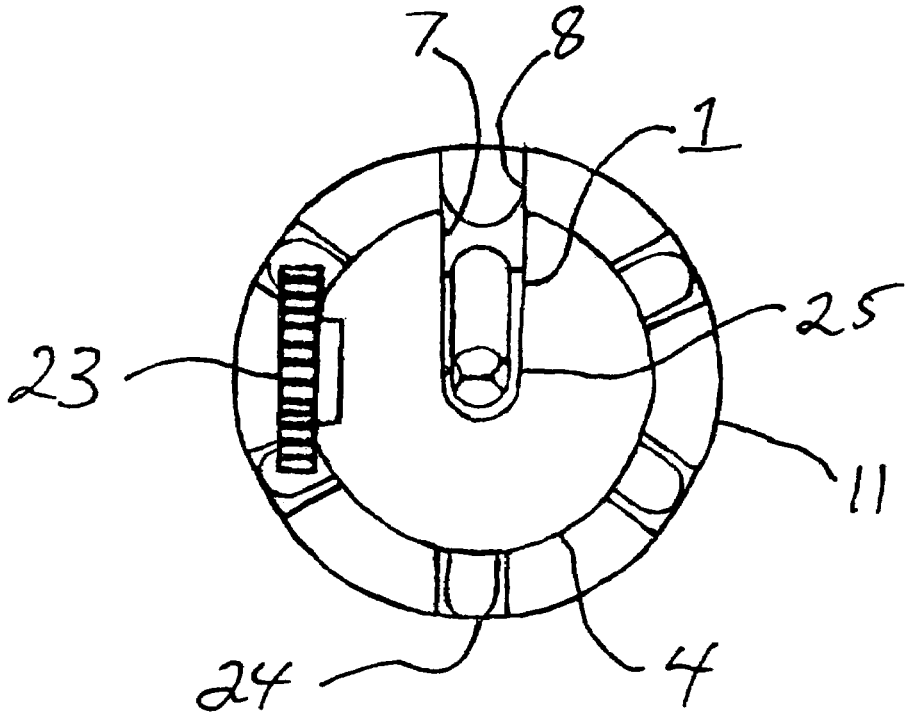
FIG. 3 is the operative end view of the hand tool with a tool bit in an operative position.
Figure 4:
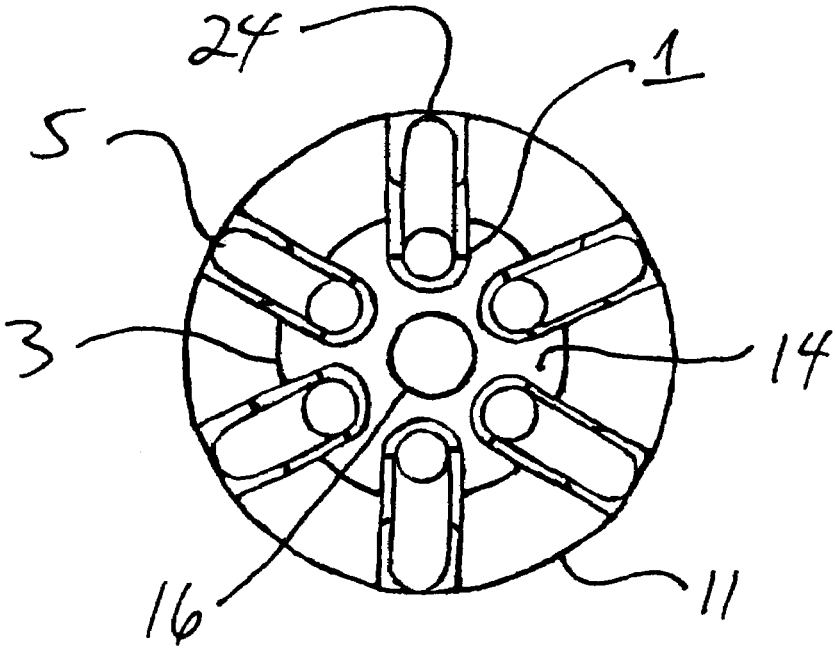
FIG. 4 is the operative end view of the hand tool storage handle with the housing device removed.

When one of the tool blades 5 is not in a storage position 24 it becomes a selected tool blade 25 the housing head 4 holds the selected tool blade 25 in place during an operative mode as shown in FIG. 1, FIG. 2 and FIG. 3.

In order to put one of the tool blades 5 from the storage handle 11 into an operative mode for a certain type of screw head the housing head slot 7 must be inline with your selected tool blade 25 tool storage slot 8 as shown in FIG. 1 and FIG. 3.

In order to put the housing head slot 7 inline with the selected tool blade 25 tool storage slot 8 the housing head 4 can pulled away 10 from the storage handle 11 freeing the indents 12 from the tool storage slots ends 14 and allowing the housing head 4 to rotate 9 perpendicular to the longitudinal axis 28 of the storage handle 11 until the housing head slot 7 and the selected storage slot 8 are aligned as shown in FIG. 1, FIG. 2 and FIG. 3.

The housing head 4 when released it is pulled back 20 on the storage handle head 3 by the spring 18 as shown in FIG. 2 and FIG. 5.

The housing head 4 indents 12 will rest back on the tool storage slots ends 14 locking the housing head 4 in place on the storage handle 11 for the operative mode as shown in FIG. 2.

A cavity 21 at the end of the storage handle 11 allows the operators finger to pull the selected tool blade 25 out of the tool storage slot 8 as shown in FIG. 2.

The selected tool blade 25 can be rotated 180 degrees 22 into the housing head slot 7 creating an operative position for the selected tool blade 25, the housing head 4 is ridged when locked in place on the storage handle 11, and this prevents circumferential twisting of the selected tool blade 25 when force is applied during use as shown in FIG. 1.

The housing head has a locking screw 23 which is perpendicular to the selected tool blade 25 longitudinal axis this prevents the selected tool blade 25 from slipping out of the housing head 4 when in operation as shown in FIG. 1 and FIG. 3.

After use the selected tool blade 25 can be unlocked and rotated back into the tool storage slots 8 as shown in FIG. 1.

The storage handle head 3 of the storage handle 11 indents into the housing head 4 because of a housing head flaring 26 on the housing head 4 that extends circumferentially around the storage handle head 3 of the storage handle 11 and over top of the tool blade 5 pin 1 ends which prevents the unselected tool blades 5 from being extracted out of the tool storage slots 8 as shown in FIG. 2 and FIG. 5.

The housing head slot 7 cuts into the housing head flaring 26 which allows for a passageway for a selected tool blade 25 as shown in FIG. 2 and FIG. 5.

Those skilled in the art to which this invention relates too are able to do variations in its practice and modes of construction. Thus this invention is not intended to be limited by the illustrative description presented hereinabove, but should be encompassed in the spirit and scope of the appended claims.

What is claimed is:

1. A hand tool for fastening screws or bolts wherein said hand tool comprising:

A storage handle with an assortment of tool blades spaced in a circumference and longitudinal to the axis of each on the said storage handle, each said tool blades are attached at one longitudinal end of the said storage handle, allowing for the pivoting of said tool blade 180 degrees to the longitudinal axis of the said storage handle, the other end of the longitudinal axis of the tool blade is specifically designed to interact with different screw or bolt heads, at the said longitudinal end of the said storage handle of the attached end of the said tool blades is a fixed housing device, said housing device can rotate perpendicular to the said longitudinal axis of the said storage handle when unlocked, said housing device can align with each said tool blade individually, when said housing device is aligned with a slected said tool blade said tool blade can be pivoted 180 degrees out of the said storage handle, when said tool blade is seated in said housing device said tool blade is ridgedly fixed and is able to withstand rotating torque when fastening or unfastening said screws or bolts.

2. A hand tool for fastening or unfastening screws or bolts according to claim 1 wherein said tool blades are in grooves spaced in a circumference longitudinal to the axis of the said storage handle.

3. A hand tool for fastening or unfastening screws or bolts according to claim 1 wherein said tool blades are attached to the said storage handle by a hinge allowing for pivoting of the said tool blade 180 degrees longitudinal to the axis of the said storage handle allowing the said tool blade to be placed in an operative position in the said housing device.

4. A hand tool for fastening or unfastening screws or bolts according to claim 1 wherein said housing device has an attached rod which extends into the said storage handle, said rod is centrally located and parallel to the said storage handle longitudinal axis.

5. A hand tool for fastening or unfastening screws or bolts according to claim 4 wherein said rod slides in and out of the said storage handle and is held in tension by a spring on the said rod inside the hollow cavity of the said storage handle.

6. A hand tool for fastening or unfastening screws or bolts according to claim 5 wherein said housing device has locking teeth which interacts with locking teeth on the said storage handle when said rod is held in tension by said spring.

7. A hand tool for fastening or unfastening screws or bolts according to claim 4 wherein by pulling said housing device away from and parallel to the said storage handles longitudinal axis where by unlocking the said housing device allowing rotation of said housing device 360 degrees perpendicular to the longitudinal axis of the said storage handle.

8. A hand tool for fastening or unfastening screws or bolts according to claim 7 wherein selection of a said tool blade by alignment with a groove in the said housing device whereas creating a passageway for a said tool blade allowing for rotation into a said operative position.

9. A hand tool for fastening or unfastening a screw or bolt according to claim 8 wherein said housing device contains a locking device which holds the said tool blades in place when in an operative position.

10. A hand tool for fastening or unfastening screws or bolts according to claim 8 wherein said housing device has a flaring which extends over unslected said tool blades pivot point, preventing removal of said tool blades from said storage handle until alignment of said housing device groove with selected said tool blade creating a said passageway.

* * * * *